United States Patent [19]

Jacobs et al.

[11] Patent Number: 4,877,231

[45] Date of Patent: Oct. 31, 1989

[54] DEVICE FOR FEEDING AND DISCHARGING ORIGINALS IN SHEET FORM

[75] Inventors: Gerardus M. H. M. Jacobs, Velden; Johannes H. A. Dinnissen, Venlo, both of Netherlands

[73] Assignee: OCE-Nederland B.V., Venlo, Netherlands

[21] Appl. No.: 172,941

[22] Filed: Mar. 23, 1988

Related U.S. Application Data

[63] Continuation of Ser. No. 891,682, Jul. 29, 1986, abandoned.

[30] Foreign Application Priority Data

Aug. 2, 1985 [NL] Netherlands ..... 8502175

[51] Int. Cl.[4] ..... B65H 5/06

[52] U.S. Cl. ..... 271/3.1; 271/184; 271/902

[58] Field of Search ..... 271/3.1, 242, 902, 225, 271/184

[56] References Cited

U.S. PATENT DOCUMENTS 4,411,517 10/1983 Gerken ..... 271/902 X
4,412,740 11/1983 Buddendeck ..... 271/902 X
4,589,650 5/1986 Miyoshi ..... 271/242

*Primary Examiner*—Richard A. Schacher
*Attorney, Agent, or Firm*—Reed, Smith, Shaw & McClay

[57] ABSTRACT

A device which can feed originals from a holder via a feed path to an exposure window using a cooperating pair of rollers and a conveyor device, the direction of movement of which can be reversed to allow returning of the originals via a discharge path to the holder. The pair of rollers is provided with a drive mechanism and a coupling belt which, during conveyance of an original to the exposure window, convey the original to and on the window in cooperation with the conveyor device and which stop the pair of rollers or reverse the direction of movement of the rollers during the conveyance of an original from the exposure window to the discharge path in order to inhibit feeding of the new original on one hand, and to position the new original on the other hand. There is a fixed time relation between the times at which the states of the movement of the pair of rollers and the conveyor device change.

3 Claims, 1 Drawing Sheet

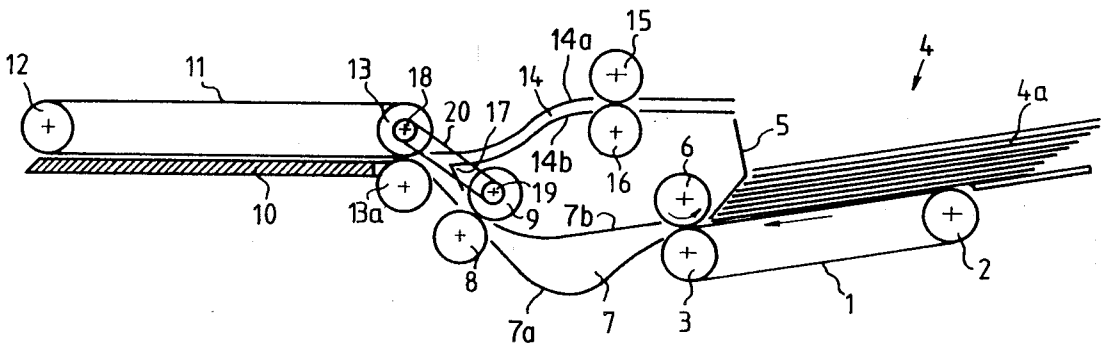
4a
4
2
1
5
6
3
15
16
7
14a
14
14b
7b
19
9
7a
17
8
20
18
13
13a
10
11
12

DEVICE FOR FEEDING AND DISCHARGING ORIGINALS IN SHEET FORM

This is a continuation of co-pending application Ser. No. 891,682, filed July 29, 1986, now abandoned.

FIELD OF THE INVENTION

The present invention relates to a document feeder and, in particular, to a document feeder for use in delivering originals to an exposure station and removing them therefrom in a photocopy machine.

BACKGROUND OF THE INVENTION

Devices for feeding originals in sheet form to and discharging them from an exposure window of a copy machine are well known; for example, U.S. Pat. Nos. 3,556,511 and 3,556,512 and United Kingdom Pat. No. 2,040,887. Generally, they comprise a holder for a pile of originals and a separator for taking originals from the pile one by one. A feed path is provided for guiding the originals from the pile to the exposure window of the copier which consists of a cooperating pair of rollers mounted in the feed path for conveying the originals in the feed path. A conveyor is provided which can be driven in a first direction for conveying the originals from the feed path to and over the exposure window and in the opposite, second, direction for removing the originals from the exposure window. The discharge path is used for returning the originals from the exposure window to the pile. A drive means is included which drives the pair of rollers in a direction in which the pair of rollers together with the conveyor device convey originals during or substantially during the periods of time in which the conveyor device is driven in the first direction.

In U.S. Pat. No. 3,556,512, for example, a device for changing originals in sheet form on an exposure window of a copying machine is described in which the feeder is provided with a first detector in the feed path between the pair of rollers and the conveyor device. In response to the passage of the leading edge of an original, this detector generates a signal which is used to stop the drive for the pair of rollers until a second detector in the discharge path has detected that the original to be changed has passed this second detector. During the conveyance of an original to and over the exposure window, the pair of rollers and the conveyor are driven in the same direction. To discharge the original, the direction of movement of the conveyor is reversed, but the pair of rollers move at a slower speed in the original direction until a new original has arrived at the first detector. To allow movement of the various elements at the correct times, a complex drive and detection system is used, in which the pair of rollers is alternately coupled to the conveyor and to the separator.

Another disadvantage of the known device is that the position in which an original is located after the drive of the pair of rollers has been stopped is not always the same, because uncontrollable inertia phenomena occur between the time of detection of the original and stopping of the rollers. In order to obtain a defined position of the original on the exposure window, an extra stop is used to overcome this problem.

Accordingly, an object of the present invention is to provide a simplified device means for feeding and discharging originals without reducing the possibilities of use. It is a further object of the present invention to provide an improvement in the prior art feeders without complicated drive and detection means.

SUMMARY OF THE INVENTION

Generally, in the present invention the drive means are provided with coupling means which stop the pair of rollers or reverse the direction of their movement during or substantially during the periods of time in which the conveyor is driven in the second direction. The invention utilizes a fixed time relationship between the times at which the states of movement of the pair of rollers and the conveying direction is changed.

Other advantages of the present invention will become apparent from a perusal of the following detailed description of the presently preferred embodiment taken in connection with the accompanying drawing.

BRIEF DESCRIPTION OF THE DRAWINGS

FIG. 1 is a diagrammatically representation of a preferred embodiment of the invention.

PRESENTLY PREFERRED EMBODIMENT

Referring to FIG. 1, conveyor belt 1 is shown entrained over two rollers 2 and 3 to form part of the bottom of an original document holder 4. The holder outlet side is bounded by a plate 5 which is obliquely bent outwardly so that the originals of a pile 4*a* of originals can lie in a somewhat offset relationship to one another in holder 4. Above roller 3, which is situated at the outlet side, outside the bottom of holder 4, there is disposed friction roller 6 which prevents the discharge of a plurality of originals at the same time. A feed path 7 is fixed at the outlet side of the nip between belt 1 and friction roller 6. This feed path consists of two plates 7*a* and 7*b*. The bottom plate 7*a* is provided with a bent part having the top extending downwardly.

Aperatures are formed in feed path plates 7*a* and 7*b* and a cooperating pair of rollers 8 and 9 is mounted therein. The feed path extends as far as glass plate 10 which is positioned on the top surface of a copying machine (not shown) for exposure of the originals to light. A conveyor belt 11 running about two rollers 12 and 13 is mounted on the glass plate. Beneath the roller 13, glass plate 10 contains a recess in which a roller 13*a*, which cooperates with belt 11, is mounted.

Near the point where feed path 7 and glass plate 10 adjoin one another, discharge path 14 is branched from feed path 7, and, as with feed path 7, consists of two plates 14*a* and 14*b*. A set of cooperating rollers 15 and 16 are disposed in discharge path 14 to convey originals in this path. Angle 17 between feed path 7 and discharge path 14 is somewhat lower than the top surface of glass plate 10 so that an original conveyed from glass plate 10 to discharge path 14 cannot enter feed path 7. A toothed belt wheel 18 is mounted on the spindle of roller 13 and a toothed belt wheel 19 is mounted on the spindle of roller 9. These toothed belt wheels are directly coupled together by means of toothed belt 20.

The device represented in FIG. 1 operates as follows: When an original is conveyed from the bottom of the pile from holder 4 into feed path 7, belt 1 and friction roller 6 rotate in the direction indicated by the arrows. Conveyor belt 11 and roller 9 of cooperating pair of rollers rotate in the anti-clockwise direction (looking at the drawing), so that the original is not conveyed any further when it reaches the nip between roller pairs 8 and 9. The downwardly inverted feed path plate gives the original the opportunity of buckling and positioning itself accurately against the nip between the roller pairs 8 and 9 because the original is longer than the path to be covered between the rollers 3 and 8 and belt 1 moves long enough in order to bring the original buckled into the nip between roller pairs 8 and 9.

In the meantime, conveyor belt 11 can convey back to holder 4 via discharge path 14 a previously conveyed original lying on glass plate 10, the original being deposited on the pile 4a in the holder. After belt 11 has rotated during a predetermined time sufficient for the discharge of the previously conveyed original, the direction of movement of the conveyor belt 11 and that of roller pairs 8 and 9 is reversed and the next original lying ready in the nip of these rollers can be conveyed on the glass plate 10. The original is stopped in the correct position there because the conveyor belt and rollers are driven in this direction during a predetermined time. A new original is fed each time from holder 4 as far as in the nip between rollers 8 and 9 during the time in which the previous original is discharged.

In an alternative embodiment according to the invention, one of the toothed belt wheels 18 and 19 is mounted on the associated spindle via a one-way clutch, so that roller pairs 8 and 9 are driven together with belt 11 during the conveying of an original to and over glass plate 10, but the pair of rollers is not driven when belt 11 is driven in the opposite direction for the discharge of the original.

It is also possible to effect coupling of the directions of conveyance of conveyor belt 11 and the pair of roller pairs 8 and 9 electronically instead of mechanically. In that case there must be a fixed relationship between the times at which the states of movement of the conveyor belt and the pair of rollers change, but these times need not necessarily coincide. Depending on the dimensions of the originals, the length of the various paths to be covered by the originals, and the conveying speeds, small predetermined differences between these times may be permissible.

While presently preferred embodiments of the invention have been shown and described, the invention may be otherwise embodied within the scope of the appended claims.

What is claimed is:

1. In a device for feeding originals in sheet form to and from an exposure window of a copying machine having: a holder for storing originals; a feed path for guiding said originals from said holder to said exposure window; a cooperating pair of rollers mounted in said feed path for conveying the originals therein; a conveyor adapted to be driven in a first direction for conveying said originals from said feed path to and over said exposure window and thereafter driven in a second and opposite direction for removing the originals from said exposure window; a discharge path for returning said originals from said exposure window to said holder; and a drive means for driving said pair of rollers, the improvement in combination therewith comprising a mechanical coupling means mounted between said pair of rollers and said conveyor for stopping said pair of rollers or reversing the direction of rotation of said pair of rollers during or substantially during the periods of time in which said conveyor is driven in said second direction, whereby there is a fixed time relationship between the times at which the states of rotation of said pair of rollers and the conveying direction change.

2. In a device according to claim 1, wherein said coupling means reverse direction of said pair of rollers at the same or substantially the same times as those at which the direction of movement of said conveyor is reversed.

3. In a device according to claim 2, wherein said coupling means comprises a fixed coupling for simultaneously driving said pair of rollers and said conveyor.

* * * * *